United States Patent [19]

Riggs, Jr.

[11] 4,279,705

[45] Jul. 21, 1981

[54] PROCESS FOR OXIDIZING A METAL OF VARIABLE VALENCE BY CONSTANT CURRENT ELECTROLYSIS

[75] Inventor: Olen L. Riggs, Jr., Bethany, Okla.

[73] Assignee: Kerr-McGee Corporation, Oklahoma City, Okla.

[21] Appl. No.: 122,585

[22] Filed: Feb. 19, 1980

[51] Int. Cl.[3] ..... C25C 1/22; C25B 1/00

[52] U.S. Cl. ..... 204/1.5; 204/90; 204/290 F

[58] Field of Search ..... 204/1.5, 90, 290 F

[56] References Cited

U.S. PATENT DOCUMENTS

| | | | |
|---|---|---|---|
| 2,288,752 | 7/1942 | Simpson | 204/90 |
| 3,361,651 | 1/1968 | Parkinson et al. | 204/1.5 |
| 3,479,139 | 11/1969 | Koerner | 423/231R |
| 3,616,276 | 10/1971 | Schneider | 204/1.5 |
| 3,770,612 | 11/1973 | Gray et al. | 204/1.5 X |
| 3,836,476 | 9/1974 | Baldwin et al. | 252/301.1 R |
| 4,028,215 | 6/1977 | Lewis et al. | 204/290 F |

*Primary Examiner*—Leland A. Sebastian

*Attorney, Agent, or Firm*—William G. Addison

[57] ABSTRACT

A process for oxidizing a metal of variable valence to a higher valence state by electrochemical means. More particularly, a process for oxidizing a metal of variable valence, such as, for example, uranium or vanadium contained in wet process phosphoric acid to a higher valence state for extraction by subsequent contact with complex organic extractants. The wet process phosphoric acid is oxidized in an electrolytic cell operated at a constant current density. The cell comprises a tank having at least one anode having a surface coating containing manganese dioxide and at least one cathode, said anode and cathode having a ratio of surface areas exposed to the electrolyte in said cell of from at least about 100:1.

9 Claims, 1 Drawing Figure

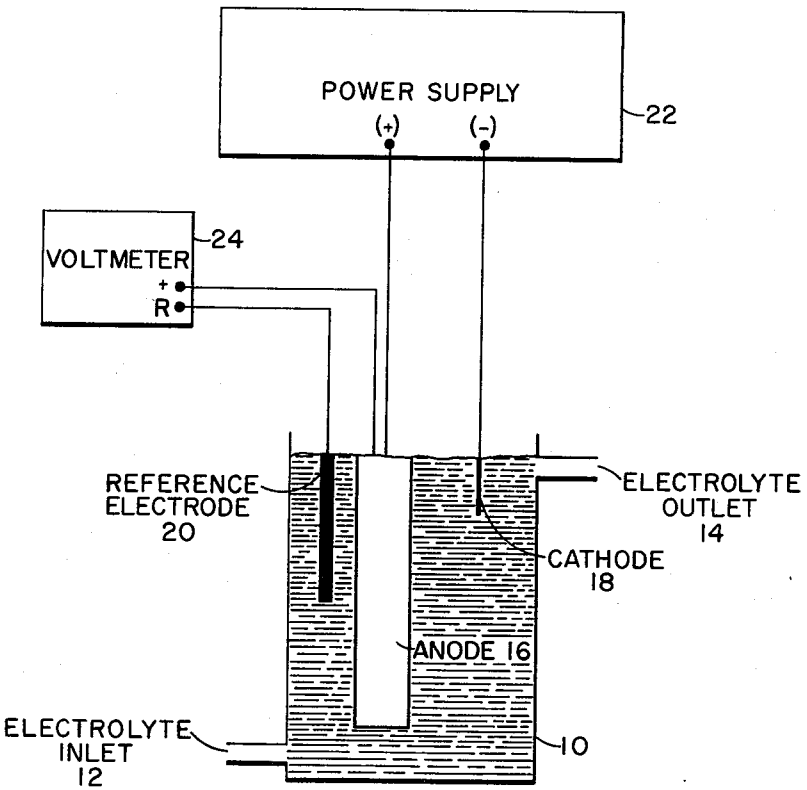
POWER SUPPLY
22
(-)
(+)
VOLTMETER
24
+
R
ELECTROLYTE OUTLET 14
CATHODE 18
ANODE 16
10
REFERENCE ELECTRODE 20
ELECTROLYTE INLET 12

PROCESS FOR OXIDIZING A METAL OF VARIABLE VALENCE BY CONSTANT CURRENT ELECTROLYSIS

BACKGROUND OF THE INVENTION

1. Field of the Invention

This invention relates to a process for oxidizing a metal of variable valence by electrochemical means. More particularly, this invention relates to a process for oxidizing either or both vanadium and uranium contained in wet process phosphoric acid to a higher valence state whereby either or both can be extracted from the acid by subsequent contact with complex organic extractants.

2. Description of the Prior Art

Various commercial processes require a metal of variable valence in an aqueous or organic solution to be in a particular valence state. For example, there are processes for the simultaneous coextraction of pentavalent vanadium and hexavalent uranium from aqueous acidic solutions containing the same, such as, for example, the process disclosed in U.S. Pat. No. 3,836,476. There also are numerous processes for the recovery of vanadium or uranium separately from wet process phosphoric acid.

Wet process phosphoric acid is produced by contacting phosphate rock with a mineral acid such as sulfuric acid. Most phosphate rock contains metal compounds which are dissolved from the phosphate rock and appear in the wet process acid as contaminants. Vanadium and uranium compounds are among those dissolved from the phosphate rock, particularly when the rock is from the so-called western deposits of Idaho, Wyoming, Utah and Montana.

In the coextraction processes, and many of the other processes, it is necessary to oxidize the vanadium and uranium in the wet process phosphoric acid to a higher valence state to enable the vanadium and uranium to be separated.

In the past, this oxidation has been achieved through the addition of chemical oxidants in an amount in excess of the stoichiometric requirement for oxidizing all the vanadium to pentavalent vanadium and all the uranium to hexavalent uranium. Normally, the oxidant is added in an amount of from about 50 percent to 1000 percent in excess of that which is stoichiometrically required. Various oxidizing agents have been used such as chlorates, manganese dioxide, permanganates, dichromates, peroxydisulfates, and ceric salts.

The disadvantages resulting from chemical oxidation are increased process expense, the possibility of increased plant corrosion, and further contamination of the acidic solution through addition of the oxidizing agent.

Though while not applied to the oxidation of vanadium and uranium, it is known that phosphoric acid containing trivalent iron impurities can be purified by direct current electrolytic reduction of the iron to the divalent oxidation state and precipitation of the iron impurities by the process disclosed in U.S. Pat. No. 2,288,752, or by direct current electrolytic reduction of the iron impurities and recovery of the phosphoric acid by extraction with a water-insoluble amine extractant, such as disclosed in U.S. Pat. No. 3,479,139.

It is desirable to provide a process whereby a metal of variable valence, such as, vanadium or uranium may be oxidized by electrolytic means with improved current efficiency.

SUMMARY OF THE INVENTION

The discovery now has been made that various metals of variable valence in solutions can be efficiently oxidized through electrolytic oxidation by constant current techniques employing an anode having a surface coating containing manganese dioxide.

The present invention includes a compact electrolytic cell which is capable of operating in a continuous manner at high current efficiency over extended periods of time. This cell has a relatively low operating cost due, in part, to the prolonged life of the electrodes, and the absence of diaphragms or other semi-permeable membranes which normally are required to separate the anode and cathode within a cell, which lowers material and maintenance costs.

Broadly, the electrolytic cell of this invention comprises a tank having an inlet and an outlet for an electrolyte solution. The tank contains at least one anode having a surface coating containing manganese dioxide and at least one cathode. To eliminate the need for a diaphragm or semi-permeable membrane within the electrolytic cell, the anode and cathode have a ratio of surface areas exposed to the electrolyte of from at least about 100:1. Preferably, the ratio of anode to cathode surface area exposed to the electrolyte is greater than 300:1 and most preferably greater than 500:1. The preferred cathode surface area is the maximum area which is required to maintain the cathodic current density of the electrolytic cell sufficiently high such that substantially the only electrochemical reaction effected at the cathode is the preferential reduction of hydrogen while the metal of variable valence is oxidized at the anode of the electrolytic cell.

BRIEF DESCRIPTION OF THE DRAWING

The drawing is a diagrammatic schematic illustration of the electrolytic cell and process of this invention.

DESCRIPTION OF THE PREFERRED EMBODIMENT

Broadly, the present invention is applicable to changing the valence of a single metal or several metals in a solution such that they can be further processed. In particular, the process of the invention can be used to oxidize trivalent and quadrivalent vanadium to pentavalent vanadium and quadrivalent uranium to hexavalent uranium in a wet process phosphoric acid solution.

Referring now to the drawing, the electrolytic cell employed in performing the process of the present invention is illustrated. The cell 10 is provided with an electrolyte inlet 12 and an electrolyte outlet 14. As specifically illustrated, the electrolyte inlet 12 and electrolyte outlet 14 are arranged to maintain a constant fluid level within the cell 10. The electrolyte may be introduced by, for example, pumping or gravity regulated flow. The specific location of the electrolyte inlet 12 and electrolyte outlet 14 in cell 10 may vary. The cell 10 also contains an anode 16, a cathode 18 and a standard reference electrode halfcell comprising a reference electrode 20. The cathode can be made of, for example, copper, nickel, mild steel, stainless steel, graphite, platinum or the like. The reference electrode may be, for example, a standard calomel electrode, a silver/silver chloride electrode, a mercury/mercury sulfate electrode or the like.

The anode can be made of a substrate such as, for example, platinum, tantalum, niobium, titanium, titanium alloys or the like which has a surface coating containing manganese dioxide. One process for the production of such an anode is disclosed in U.S. patent application Ser. No. 949,885 entitled "An Electrode And Process For Oxidizing Vanadium And/Or Uranium" filed Oct. 10, 1978 now U.S. Pat. No. 4,222,826, the disclosure of which is incorporated herein by reference. Another process for the production of a manganese dioxide coated electrode is disclosed in U.S. Pat. No. 4,028,215 the disclosure of which is incorporated herein by reference. It has been found that when an anode such as that described is employed to oxidize either or both vanadium and uranium in wet process phosphoric acid, the cell voltage is less than when any other known anode such as a noble metal or alloy is used. The current efficiency of the electrolytic process also is greater than when any other known anode is used.

Normally, in an electrochemical process wherein a change in valence of a metal of variable valence is to be effected, such as in U.S. Pat. Nos. 3,361,651, 3,616,276, or 3,770,612, the disclosures of which are incorporated herein by reference, the anode is separated from the cathode in the electrolytic cell by a diaphragm or semi-permeable membrane. The diaphragm is present to impede the migration of the oxidized or reduced specie in the electrolyte from the anode or cathode, respectively, to the opposing electrode at which the oxidized or reduced specie would be returned to its former valence state.

The surprising discovery now has been made that if the ratio of the surface area of the anode to the surface area of the cathode exposed to the electrolyte is controlled to provide a ratio of from at least about 100:1, that no diaphragm or other semi-permeable membrane is required in the electrolytic cell of this invention. Preferably, the ratio of the anode to cathode surface areas exposed to the electrolyte is greater than 300:1 and most preferably greater than 500:1. The preferred cathode surface area is the maximum area which is required to maintain the cathodic current density of the electrolytic cell sufficiently high such that substantially the only electrochemical reaction effected at the cathode is the preferential reduction of hydrogen while the metal of variable valence is oxidized at the anode of the electrolytic cell.

The oxidation of the metal of variable valence in the cell 10 is effected by supplying a constant current with a power supply 22 sufficient to provide an initial preselected potential between the anode 16 and the reference electrode 20. The reference electrode of the standard reference electrode half-cell senses the electrochemical potential of the anode and produces an electrical signal that is transmitted to a voltmeter 24 which is capable of converting the signal into a visually perceptable display of the potential. The current output of the power supply 22 is adjusted to provide the desired potential reading on voltmeter 24 after which the power supply 22 then causes the electrical voltage applied to the electrolytic cell to vary as required to maintain the selected current value.

Thus, the current density is determined by applying constant current of such value to the anode that the measured potential will reach or slightly exceed the lower electrochemical potential limit for either or both uranium and vanadium oxidation. In that the applied current remains at the adjusted value constantly, all of the metal of variable valence is permitted to substantially oxidize to the higher valence level prior to the monitored potential exceeding the upper potential limit for oxidation. The particular potential selected to determine the necessary current output of power supply 22 is a function of the particular reference electrode half-cell employed in the process. The particular potential value may be adjusted to compensate for the differences between various reference electrodes. The magnitude of the adjustment is in the order of the difference between the particular electrode's reference potentials.

When the electrolyte in cell 10 comprises WPA containing either or both uranium and vanadium, and the reference electrode 20 is a silver/silver chloride electrode, the potential value employed to determine the necessary output of power supply 22 is in the range of from about +1250 millivolts to about +1500 millivolts versus the reference electrode to oxidize the uranium to the hexavalent state and the vanadium to the pentavalent state. Preferably, the control potential is maintained in the range of from about +1250 millivolts to about +1350 millivolts. The upper potential limit for the oxidization of uranium and vanadium is above about +1650 millivolts versus the reference electrode.

The lower and upper potential limits are determined by potentiodynamic anodic polarization of an inert anode comprising platinum which is exposed in the subject solution. The results of the polarization test can be recorded graphically to permit a comparison of applied current to electrochemical potential response for the oxidation reactions of metals of variable valence contained in the solution. The lower and upper potential limits then are taken as the corresponding potential value for initiation and finalization of the oxidation reaction of the desired metal value illustrated by the graphical record.

The treatment time required to oxidize the metal of variable valence in the electrolyte is a function of the concentration of the metal present in the electrolyte.

To further illustrate the process of this invention, and not by way of limitation, the following examples are provided.

EXAMPLE I

This example illustrates the effect the manganese dioxide coating has upon the rate of the oxidation process.

First a test is performed in which an electrolytic cell 10 is provided with a platinized titanium anode and a stainless steel cathode. The anode has a surface area of 8 square inches. The cathode has a surface area of 0.012 square inches. The electrolyte comprises 250 milliliters of WPA containing 18 milliequivalents of quadrivalent vanadium per liter of solution. The temperature of the electrolyte in the cell is 50 degrees C. The reference electrode is a silver/silver chloride electrode and the power supply 22 is adjusted to provide a potential value of +1300 millivolts versus the reference electrode on voltmeter 24.

The cell is operated under constant current until vanadium oxidation is complete as determined by samples which are periodically withdrawn from the electrolytic cell 10 and analyzed. The results of the analytical tests then are graphically plotted and graphically integrated to determine the oxidation rate with respect to the particular anode. The oxidation rate for the platinum electrode is found to be approximately 0.21 milliequivalents/$ft^2$/min.

A second test is performed in which the platinized titanium anode is replaced with a platinized titanium anode having a surface coating of manganese dioxide and the electrolyte is replaced with fresh WPA.

The cell is operated as before to determine the oxidation rate. The oxidation rate for an anode having a surface coating of manganese dioxide is found to be over 4 times that of the platinized titanium anode.

The significant improvement in the oxidation rate of the quadrivalent vanadium for the anode of the present invention over a conventional platinized anode clearly demonstrates the superiority of such an anode.

EXAMPLE II

This example illustrates the effect the ratio of the surface area of the anode to the surface area of the cathode has upon the operability of the process.

First, a test is performed in which an electrolytic cell 10 is provided with a platinized titanium anode 16 having an electrodeposited coating of manganese dioxide and a stainless steel cathode 18. The anode 16 has a surface area of about 8 square inches. The ratio of the surface area of the anode to the surface area of the cathode is 10:1. The electrolyte comprises 250 milliliters of WPA containing 24 milliequivalents of vanadium per liter of solution as $V_2O_5$. The temperature of the electrolyte in the cell is 50 degrees C. The reference electrode is a silver/silver chloride electrode. The current output of power supply 22 is adjusted to provide a potential value measured between the anode and the reference electrode of +1300 millivolts as displayed on voltmeter 24.

Initially, vanadium oxidation occurs at the anode and hydrogen gas is evolved at the cathode. After less than 1 hour, no hydrogen evolution is visible at the cathode. The potential measured between the anode and the reference electrode increases slightly and then remains steady at a level below +1600 millivolts. This indicates that the vanadium oxidation process has reached an equilibrium condition in which pentavalent vanadium is reduced at the cathode to quadrivalent vanadium as further quadrivalent vanadium is oxidized to the pentavalent state at the anode.

A second test is performed in which the cathode 18 in the electrolytic cell 10 is replaced with a stainless steel cathode having a surface area of about 0.012 square inches. The ratio of surface areas now is about 667:1. The electrolyte is replaced with fresh WPA containing 24 milliequivalents of vanadium per liter of solution as $V_2O_5$. The cell is operated as before, however in this test, hydrogen gas evolves continuously and thus no equilibrium condition is found to occur. After about two hours, the potential measured between the anode and the reference electrode begins to increase rapidly to a level about +1650 millivolts. The rapid change in the potential measured between the anode and reference electrode to a level above +1650 millivolts indicates that the vanadium in the electrolyte is completely oxidized.

The test results clearly demonstrates that the ratio of the surface area of the anode to the surface area of the cathode in the electrolytic cell has an effect upon the oxidation of a metal in an electrolytic cell which contains no diaphragm or other semi-permeable membrane to separate the cell into separate anode and cathode compartments.

While the present invention has been described with regard to that which is considered to be the preferred embodiment thereof, it is to be understood that changes can be made in the process without departing from the spirit or scope of the invention as set forth in the following claims.

I claim:

1. A process for changing the valence of a metal of variable valence state in a solution to a higher valence state which comprises:

providing an electrolytic cell containing an electrolyte comprising the solution containing the metal of variable valence and having an anode and a cathode positioned therein, said anode having a surface coating containing manganese dioxide, said anode and cathode having an anode surface area to cathode surface area ratio of at least about 100:1 exposed to said electrolyte in said cell, said cell having no separate anode and cathode compartments within said cell;

electrolyzing said electrolyte within said electrolytic cell by constant current means to change the valence of the metal of variable valence state to a higher valence state.

2. The process of claim 1 wherein the electrolyte is wet process phosphoric acid containing at least one member selected from the group of uranium and vanadium.

3. The process of claim 1 wherein the ratio of anode to cathode surface area is defined further as being greater than about 300:1.

4. The process of claim 1 in which the surface area of the cathode is maintained at the maximum area which maintains the cathodic current density of the electrolytic cell sufficiently high such that substantially the only electrochemical reaction to occur at the cathode in the electrolytic cell is the preferential reduction of hydrogen while the valence of the metal of variable valence state contained in the electrolyte within the electrolytic cell is changed to a higher valence state.

5. The process of claim 1 wherein said electrolytic cell is provided with a reference electrode in ionic contact with said electrolyte in said cell to measure the electrochemical potential between said anode and said reference electrode.

6. The process of claim 5 wherein the electrochemical potential measured between said reference electrode and said anode is used to determine the level of constant current applied to said electrolytic cell.

7. The process of claim 6 wherein the level of current applied to said electrolytic cell is such that the electrochemical potential measured between said reference electrode and said anode is in the range of from about +1250 millivolts to about +1500 millivolts.

8. The process of claim 6 wherein the level of current applied to said electrolytic cell is such that the electrochemical potential measured between said reference electrode and said anode is in the range of from about +1250 millivolts to about +1350 millivolts.

9. The process of claim 1 wherein the ratio of anode to cathode surface area is defined further as being greater than about 500:1.

* * * * *